US007041425B2

(12) United States Patent
Hopper et al.

(10) Patent No.: US 7,041,425 B2
(45) Date of Patent: May 9, 2006

(54) TONER PROCESSES

(75) Inventors: Michael A. Hopper, Toronto (CA); Joseph Bartel, Dublin, CA (US); Maria N. V. McDougall, Burlington (CA); Patricia A. Burns, Milton (CA); Richard P. N. Veregin, Mississauga (CA)

(73) Assignee: Xerox Corporation, Stamford, CT (US)

( * ) Notice: Subject to any disclaimer, the term of this patent is extended or adjusted under 35 U.S.C. 154(b) by 178 days.

(21) Appl. No.: 10/775,365

(22) Filed: Feb. 10, 2004

(65) Prior Publication Data

US 2005/0176853 A1 Aug. 11, 2005

(51) Int. Cl.
*G03G 5/00* (2006.01)

(52) U.S. Cl. ..... 430/137.14; 523/334

(58) Field of Classification Search ..... 430/137.14; 523/334

See application file for complete search history.

(56) References Cited

U.S. PATENT DOCUMENTS

| | | | | |
|---|---|---|---|---|
| 4,983,488 | A | 1/1991 | Tan et al. | 430/137 |
| 4,996,127 | A | 2/1991 | Hasegawa et al. | 430/109 |
| 5,650,256 | A | 7/1997 | Veregin et al. | 430/137 |
| 5,828,933 | A | 10/1998 | Rees et al. | 399/223 |
| 5,994,020 | A | 11/1999 | Patel et al. | 430/137 |
| 6,120,967 | A | 9/2000 | Hopper et al. | |
| 6,132,924 | A | 10/2000 | Patel et al. | 430/137 |
| 6,190,820 | B1 | 2/2001 | Patel et al. | |
| 6,268,102 | B1 | 7/2001 | Hopper et al. | 430/137.14 |
| 6,395,445 | B1 * | 5/2002 | Toth et al. | 430/137.14 |
| 6,416,920 | B1 * | 7/2002 | Hopper et al. | 430/137.14 |
| 6,500,597 | B1 | 12/2002 | Patel et al. | |
| 6,664,017 | B1 * | 12/2003 | Patel et al. | 430/137.14 |
| 2002/0187415 | A1 | 12/2002 | Jiang et al. | |
| 2003/0059704 | A1 | 3/2003 | Varbesien et al. | |
| 2003/0162119 | A1 | 8/2003 | Varbesien et al. | |

* cited by examiner

*Primary Examiner*—Mark A. Chapman
(74) *Attorney, Agent, or Firm*—E. O. Palazzo

(57) ABSTRACT

A process including blending a latex emulsion of resin, water, and an ionic surfactant, a colorant dispersion comprised of a colorant, water, and an ionic surfactant; and a wax dispersion comprised of wax, water and an ionic surfactant, heating the resulting mixture in the presence of coagulants, one of which is a source of calcium ions, which heating is below about the glass transition temperature (Tg) of the latex resin and subsequently heating above about the glass transition temperature (Tg) of the latex resin.

29 Claims, No Drawings

TONER PROCESSES

RELATED PATENTS

Illustrated in U.S. Pat. No. 5,650,256, the disclosure of which is totally incorporated herein by reference, is, for example, a process for the preparation of toner comprising:

(i) preparing a pigment dispersion, which dispersion is comprised of a pigment, and an ionic surfactant;

(ii) shearing the pigment dispersion with a latex or emulsion blend comprised of resin, a counterionic surfactant with a charge polarity of opposite sign to that of the ionic surfactant and a nonionic surfactant, and wherein the resin contains an acid functionality;

(iii) heating the above sheared blend below about the glass transition temperature (Tg) of the resin to form electrostatically bound toner size aggregates;

(iv) adding anionic surfactant to stabilize the aggregates obtained in (iii);

(v) coalescing the aggregates by heating the bound aggregates above about the Tg of the resin;

(vi) reacting the resin of (v) with acid functionality with a base to form an acrylic acid salt, and which salt is ion exchanged in water with a base or a salt, optionally in the presence of metal oxide particles, to control the toner triboelectrical charge, which toner is comprised of resin and pigment; and (vii) optionally drying the toner obtained, and wherein the ion exchange salt can be $ZnCl_2$, or wherein the ion exchange salt can be $CaCl_2$.

Illustrated in U.S. Pat. Nos. 5,828,933; 6,495,302; 6,416,920; 6,500,597; 6,562,541 and 6,576,389, the disclosures of which are totally incorporated herein by reference, are toner processes wherein a coagulant may be selected.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence and wherein one of the coagulants may be polyaluminum chloride.

In U.S. Pat. No. 6,268,102, the disclosure of which is totally incorporated herein by reference, there is illustrated a process for the preparation of toner comprising mixing a colorant, a latex, and two coagulants, followed by aggregation and coalescence and wherein one of the coagulants is a polyaluminum sulfosilicate.

In U.S. Pat. No. 6,352,810, the disclosure of which is totally incorporated herein by reference, is illustrated, for example, a process of preparing a toner comprising (i) aggregating with a coagulant of a polyamine salt, a colorant, dispersion with a latex emulsion and optional additives to form aggregates followed by optionally adding a second latex emulsion to the formed aggregates;

(ii) adding an oxidizing agent to remove the excess coagulant followed by a changing the pH with a base, heating to coalesce or fuse the aggregates;

(iii) lowering the pH to accelerate the coalescence process and optionally isolating, washing and drying the toner.

Illustrated in U.S. Pat. No. 5,994,020, the disclosure of which are totally incorporated herein by reference, are toner processes, and more specifically, a process for the preparation of toner comprising (i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or above about the Tg of the latex resin; and optionally cooling, isolating, washing, and drying the toner.

The appropriate components and processes of the above recited patents may be selected for the processes of the present invention disclosed herein in embodiments thereof.

BACKGROUND AND SUMMARY

Disclosed herein are toner processes, and more specifically, chemical toner processes comprising the aggregation of a latex, colorant like pigment, or dye, and optional additive particles followed by the fusion of the aggregates into toner particles, and wherein the aggregation includes the presence of a calcium salt as an additive or coagulant, and a second coagulant, and wherein there is, more specifically, selected a latex comprised of, for example, submicron resin particles of about 0.005 to about 1 micron in volume average diameter suspended in an aqueous phase of water, and an anionic surfactant, and optionally a nonionic surfactant to which is added a colorant dispersion comprising, for example, submicron colorant particles of, for example, about 0.08 to about 0.3 micron in volume average diameter, anionic surfactant, or optionally a nonionic surfactant, or a mixture of both anionic and nonionic surfactants comprising, for example, from about 40:60 to about 60:40 weight percent mixtures of anionic to nonionic surfactant thereof, and optionally adding a wax dispersion comprising submicron wax particles of a size of, for example, about 0.1 to about 0.3 micron in volume average diameter suspended in an aqueous phase of water and an anionic surfactant, and wherein the resultant blend is stirred and heated in the presence of coagulants, one of which is a calcium salt solution, to a temperature below the resin Tg, resulting in aggregates to which optionally is added a second latex, followed by heating the mixture to a temperature above the resin Tg, washing the toner and isolating the toner product.

The toners generated with the processes illustrated herein are especially useful for imaging processes, especially xerographic processes, digital imaging processes, color processes and the like.

The following patents or publications are noted:

In xerographic systems, especially color systems, small diameter sized toners of from about 2 to about 15 microns can be of value for the achievement of high image quality for process color applications. It is also of value to have a low image pile height to eliminate, or minimize image feel and avoid paper curling after fusing. Paper curling can be particularly pronounced in xerographic color processes primarily because of the presence of relatively high toner coverage as a result of the application of three to four color toners. During fusing moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes disclosed herein.

Also, one can select certain toner particle sizes, such as from about 2 to about 10 microns, and with a high colorant, especially pigment loading such as from about 4 to about 15 percent by weight of toner, so that the mass of toner necessary for attaining the required optical density and color gamut can be reduced to eliminate or minimize paper curl. Lower toner mass also ensures the achievement of image uniformity. However, higher pigment loading often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions such as temperature and humidity. Toners prepared in accordance with the processes disclosed herein minimize, or avoid these disadvantages.

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. This process results, it is believed, in the formation of particles with a wide particle size distribution. Similarly, the aforementioned disadvantages, for example poor particle size distributions, are obtained, hence classification is required resulting in low toner yields, as illustrated in other prior art, such as U.S. Pat. No. 4,797,339, the disclosure of which is totally incorporated herein by reference, wherein there is disclosed a process for the preparation of toners by resin emulsion polymerization, wherein similar to the '127 patent certain polar resins are selected; and U.S. Pat. No. 4,558,108, the disclosure of which is totally incorporated herein by reference, wherein there is disclosed a process for the preparation of a copolymer of styrene and butadiene by specific suspension polymerization. Other prior art includes U.S. Pat. Nos. 3,674,736; 4,137,188 and 5,066,560, the disclosures of which are totally incorporated herein by reference.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488; 5,977,210; 5,994,020; 6,020,101; 6,130,021; 6,120,967 and 6,628,102.

The appropriate components and processes of the above Xerox Corporation patents can be selected for the processes illustrated and disclosed herein in embodiments thereof.

Disclosed in embodiments herein include, for example, toner processes with many of the advantages illustrated herein, inclusive for example, of generating by economical processes black toners with a low charging sensitivity to relative humidity changes, where low refers, for example, to a toner charging ratio of about 1 to about 2 for the toner when the ratio is measured at a relative humidity of from about 10 to about 25 percent to an environment when the relative humidity is between 60 and 80 percent, and which toners are especially useful for incorporation in high speed printers, that is exceeding about 100 copies per minute, and further wherein extensive washing of the toner is avoided or minimized, and wherein the toners are substantially free of surface components, such as surfactants which retain moisture thereby adversely affecting the charging characteristics of the toner; simple and economical processes for the preparation of black and colored toner compositions with excellent colorant dispersions, wherein the colorant particle size diameter is, for example, in the submicron of about 80 to about 200 nanometers and the dispersion is stable over a period of, for example, about 30 days, thus enabling the achievement of excellent color print quality and providing similar toner charging behavior despite differential colorant chemistry and enabling relative humidity insensitive toners especially at low relative humidity of, for example, from about 10 to about 25 percent; the economical preparation of chemical toners, such as styrene acrylate pigmented toner particles with coagulants, such as from about 2 to about 5, of a calcium salt, such as calcium chloride, and a second known coagulant, such as a polyaluminum chloride, and the like, which coagulants primarily function to initiate aggregation and further wherein a primary purpose of calcium salt is to reduce the charging propensity of the toner at, for example, a low relative humidity of from about 10 to about 25 percent RH, and wherein the amount of calcium salt added is, for example, from about 200 to about 800 parts per million based on the weight of the dry toner and to which can optionally be added a second latex which forms a shell on the toner aggregates; toners and processes for high speed black printers containing small highly energetic development systems such as the known Hybrid Jumping Development systems, (HJD), such as those HJD systems selected for the Xerox Corporation DC265 and other engines of the Xerox Corporation IGen3 family containing a toner with a tribo charge (as measured in microcoulombs per gram) of from about 20 to about 40 to, for example, minimize or attempt to avoid low solid area development and background deposits; moreover, as the HJD development system may be considered a relatively small intensely agitated unit it poses a severe mechanical impact on the toner which can be countered by the toner surface design; substantial elimination of rapid changes in the toner triboelectric charge especially when the toner is washed; processes wherein to resolve toner aging problems the toner contains calcium as a coagulant enabling it to spread uniformly throughout the toner particles, and wherein the toner charging characteristics do not substantially change as the toner is impacted by carrier particles while being agitated by the development system.

Aspects disclosed herein relate to a process comprising blending a latex emulsion of resin, water, and an ionic surfactant, a colorant dispersion comprised of a colorant, water, and an ionic surfactant, and a wax dispersion comprised of wax, water and an ionic surfactant; heating the resulting mixture in the presence of coagulants, one of which is a source of calcium ions, which heating is below about the glass transition temperature (Tg) of the latex resin, and subsequently heating above about the glass transition temperature (Tg) of the latex resin; a toner process comprising (i) generating a colorant dispersion comprised of a colorant, water, and an ionic surfactant, and generating a latex emulsion comprised of resin, water, and an ionic surfactant; and wherein (ii) the colorant dispersion is blended with the latex emulsion;

(iii) adding to the resulting blend containing the latex and colorant coagulants wherein one of said coagulants is a divalent or tetravalent salt;

(iv) heating the resulting mixture below about the glass transition temperature (Tg) of the latex resin;

(v) optionally adding a second latex comprised of resin particles suspended in an aqueous phase resulting in a shell;

(vi) followed by adjusting the pH of the mixture resulting with a base, and wherein the pH of the resulting toner aggregate mixture, which is at an initial pH of about 1.9 to about 3, is adjusted to a pH of about 7 to about 9;

(vii) heating the resulting aggregate suspension of (vi) above the Tg of the latex resin; and (viii) changing the pH of the above (vii) mixture by the addition of an acid to arrive at a pH of about 2.8 to about 5, followed by isolating said toner comprised of resin and colorant; a toner process comprising (i) blending a latex emulsion of resin, water, and an ionic surfactant with a colorant dispersion comprised of a colorant, water, and an ionic surfactant;

(ii) heating, in the presence of a coagulant and a calcium halide, the resulting mixture below the glass transition temperature (Tg) of the latex resin to obtain aggregates;

(iii) optionally adding a second latex comprised of submicron resin particles suspended in an aqueous phase;

(iv) adjusting the pH with a base of from an initial pH value of about 1.9 to about 3 to a pH of about 7 to about 9;

(v) heating above the latex polymer Tg temperature;

(vi) optionally retaining the temperature at from about 70° C. to about 95° C.;

(vii) changing the pH of the mixture with an acid to arrive at a pH of about 1.5 to about 3.5; and (viii) isolating the toner; a process for the preparation of toner comprising (i) generating or providing a latex emulsion containing resin, water, and an ionic surfactant, and generating or providing a colorant dispersion containing colorant, water, and an ionic surfactant, or a nonionic surfactant;

(ii) blending the latex emulsion with the colorant dispersion;

(iii) adding to the resulting blend a plurality of coagulants, one of which is a calcium salt;

(iv) heating the resulting mixture below or about equal to the glass transition temperature (Tg) of the latex resin;

(v) optionally adding a second latex comprised of resin particles suspended in an aqueous phase resulting in a shell;

(vi) heating the resulting mixture of (v) above about the Tg of the latex resin;

(vii) retaining the heating until the fusion or coalescence of resin and colorant is initiated; resulting in toner particles comprised of resin, and colorant; and (viii) retaining the mixture (vii) temperature at from about 70° C. to about 95° C. to initiate the fusion or coalescence of the toner aggregates;

(ix) changing the pH of the above (viii) mixture after about 0.5 to about 1.5 hours with an acid to arrive at a pH of about 5 to about 6 to thereby accelerate said fusion or said coalescence, resulting in a toner comprised of resin and colorant; and (x) isolating the toner; a process wherein one coagulant is $MgCl_2$, $CaCl_2$, $FeCl_3$, $CuCl_2$, $ZnCl_2$, $BaCl_2$, with $CaCl_2$ being preferred in embodiments, and which coagulant can be selected, for example, in an amount of from about 200 to about 1,000 parts per million and preferably from about 300 to about 600 parts per million by weight of the toner; a process wherein the second coagulant of, for example, a polyaluminum chloride, aluminum sulfate or potassium aluminum sulfate (alum) is selected in an amount of from about 0.15 to about 0.50 parts per hundred by weight of toner comprised of resin and colorant, and wherein the total of all solid toner components is about 100 percent; a process wherein there is added to the formed toner aggregates a second latex comprised of submicron resin particles suspended in an aqueous phase containing an ionic surfactant, and wherein the second latex is selected in an amount of about 10 to about 40 percent by weight of the latex (i) to thereby form a shell on the toner aggregates; a process wherein the polyamine salt is formed by reacting an organic aliphatic amino ester with an acid, and wherein the formed salt is selected in an amount of from about 0.05 to about 10 percent by weight of toner, and wherein the toner is comprised of a latex resin and colorant; a process wherein the second latex is added and forms a shell on the aggregates of (v), and wherein the thickness of the formed shell is from about 0.1 to about 1 micron; a process wherein the added latex contains the same resin as the initial latex of (i), or wherein the added latex contains a dissimilar resin than that of the initial latex (i); a process wherein (iv) is accomplished by heating at a temperature below about the glass transition temperature of the polymer contained in the latex to thereby form toner aggregates, and the coalescence is accomplished by heating at a temperature of above about the glass transition temperature of the polymer contained in the latex; a process wherein the aggregation temperature is from about 40° C. to about 60° C., and the coalescence temperature is from about 75° C. to about 97° C.; a process wherein the temperature at which the aggregation is accomplished controls the size of the aggregates, and wherein the final toner size is from about 2 to about 25 microns in volume average diameter; a process wherein the colorant is a pigment, and wherein the pigment is in the form of a dispersion, which dispersion contains an ionic surfactant, and wherein the coagulants function to primarily enable aggregation of the latex or polymer and the colorant; a process wherein the latex contains a resin selected from the group comprised of poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); a process wherein the colorant is carbon black, cyan, yellow, magenta, or mixtures thereof; the toner isolated is optionally from about 2 to about 15 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner; a process comprising (i) generating a colorant dispersion comprised of a colorant, water, and an ionic surfactant; separately generating a wax dispersion comprised of a polyethylene wax, water and an ionic surfactant, and separately generating a latex emulsion comprised of resin, water, and an ionic surfactant; and wherein (ii) the colorant dispersion is blended with the latex emulsion and the wax dispersion;

(iii) adding to the resulting blend containing the latex, wax and colorant a coagulant of calcium chloride and a second coagulant dissimilar than the calcium chloride;

(iv) heating the resulting mixture below about the glass transition temperature (Tg) of the latex resin;

(v) optionally adding a second latex comprised of resin particles suspended in an aqueous phase resulting in a shell;

(vii) heating the resulting aggregate suspension of (vi) above the Tg of the latex resin; and followed by isolating the toner comprised of resin, wax and colorant, and wherein the calcium chloride complexes with acidic functionality of the resin at the particle surface with the advantages of providing a toner with tribo-charging that is not strongly dependent on the relative humidity and whose charge does not substantially change to any extent as the toner is aged with carrier in an intensely mixed developer system; a process comprising (i) blending a latex emulsion of resin, water, and an ionic surfactant with a wax dispersion, water and ionic surfactant, and a colorant dispersion comprised of a colorant, water, and an ionic surfactant;

(ii) adding to the resulting blend containing the latex, wax and colorant a calcium salt together with a second cationic coagulant other than a salt of calcium;

(iii) heating the resulting mixture below about the glass transition temperature (Tg) of the latex resin to obtain aggregates; adding a second latex optionally comprised of submicron resin particles suspended in an aqueous phase to result in a shell or coating on said aggregates;

(v) heating; retaining the temperature at from about 70° C. to about 95° C., and isolating the toner; a toner process comprising aggregation of latex, colorant, and a wax in the presence of coagulants, one of which is a calcium salt, or a source of calcium, heating below and then above the resin Tg, and wherein there are generated toner compositions with, for example, a volume average diameter of from about 1 micron to about 25 microns, and more specifically, from about 2 microns to about 12 microns, and a narrow particle size distribution of, for example, from about 1.10 to about 1.33, and more specifically, a size distribution of about 1.15 to about 1.25, the size and size distribution being measured by a Coulter Counter, without the need to resort to conventional pulverization and classification methods; toner aggregation processes wherein minimum washing, for example about 2 to about 4 washings are needed, and wherein there is permitted a suitable toner triboelectrical charge such as greater than about 20 μC/g at 20 percent RH; a process wherein the added latex contains the same resin as the initial latex, or wherein the added latex contains a dissimilar resin than that of the initial latex; a process wherein the temperature at which the aggregation is accomplished controls the size of the aggregates to be from about 2 to about 15 microns, and wherein the final toner size is from about 2 to about 15 microns in volume average diameter; a process wherein the aggregation (iv) temperature is from about 45° C. to about 55° C., and wherein the coalescence or fusion temperature of (vii) and (viii) is from about 85° C. to about 95° C.; a process wherein the coagulants are added during or prior to aggregation of the latex resin, wax and colorant, and which coagulants enable or initiate the aggregation; a process wherein the colorant is carbon black, cyan, yellow, magenta, or mixtures thereof; a process wherein the toner isolated is from about 2 to about 25 microns in volume average diameter, and the particle size distribution (GSD) thereof is from about 1.15 to about 1.30; and wherein there is added to the surface of the formed toner additives, such as metal salts, metal salts of fatty acids, silicas, metal oxides, or mixtures thereof, each in an amount of from about 0.1 to about 5 weight percent of the obtained toner; a process wherein there is added to the formed toner aggregates a second latex (v) in the amount of about 10 to about 40 percent by weight of the initial latex and preferably in an amount of about 15 to about 30 weight percent to form a shell on the latex; a process wherein the added latex comprises the same resin composition and molecular properties as the initial latex used in the blending or a different composition and properties than that of the initial latex; a process wherein the aggregation is accomplished by heating at a temperature of below about the glass transition temperature of the polymer contained in the latex; a process wherein the coalescence is accomplished by heating at a temperature of above about the glass transition temperature of the polymer contained in the latex; a process wherein the aggregation temperature is from about 40° C. to about 62° C. and preferably is from about 45° C. to about 58° C.; a process wherein the coalescence temperature is from about 75° C. to about 95° C., and preferably about 85° C. to about 90° C.; a process wherein the latex contains submicron polymer or resin particles containing a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process for the preparation of toner particles resulting in images with excellent print quality wherein there is selected a latex preferably comprised of submicron resin particles which are in the size range of about 0.05 to about 0.5 micron, and more specifically, in the size range of about 0.07 to about 0.35 micron suspended in an aqueous water phase containing an ionic surfactant, which is selected in an amount of about 0.5 to about 5 percent, and more specifically, about 0.7 to about 2 percent by weight of solids, to which is added a wax dispersion comprising submicron, for example less than, or equal to about 0.5 micron, wax particles, anionic or a nonionic surfactant which is selected in the range amount of about 0.5 to about 10.0 percent and more specifically, about 0.6 to about 5 percent by weight of solids, and to which is added a colorant dispersion comprising submicron, for example less than, or equal to about 0.5 micron, colorant particles, anionic or a nonionic surfactant which is selected in the range amount of about 0.5 to about 10.0 percent and more specifically, about 0.6 to about 5 percent by weight of solids, to which is added the coagulants, 5 percent by weight of the final toner comprising latex solids, colorant and the wax components; further aggregating by stirring and heating from about 5 to about 10 degrees below the resin Tg, resulting in toner aggregates of a size of about 3 to about 15 microns, and more specifically, about 4 to about 8 microns with a narrow GSD in the range of, for example, about 1.15 to about 1.28, and more specifically, in the range of about 1.17 to about 1.25; further stirring and increasing the mixture temperature above the resin Tg in the range of about 70° C. to about 95° C., and preferably in the range of about 85° C. to about 93° C. for a period of about 0.5 to about 1.5 hours, and heating the mixture for an additional about 0.5 to about 4 hours, and more specifically, from about 0.6 to about 3 hours to fuse or coalesce the aggregates; a process for the preparation of toner compositions which comprise blending an aqueous colorant dispersion preferably containing a pigment, such as carbon black, phthalocyanine, quinacridone, red, green, orange, brown, violet, yellow, fluorescent colorant,s and the like with a latex emulsion derived from the emulsion polymerization of monomers selected, for example, from the group consisting of styrene, butadiene, acrylates, methacrylates, acrylonitrile, acrylic acid, methacrylic acid, itaconic or beta carboxy ethyl acrylate (β CEA) and the like, and which latex contains an ionic surfactant, such as sodium dodecylbenzene sulfonate, and optionally a nonionic surfactant, and which process is accomplished in the presence of coagulants and an additive of a source of calcium, such as calcium chloride; polyaluminum chloride or a metal salt; and a process wherein the particle size of the toner provided by the processes disclosed herein in embodiments can be controlled, for example, by the temperature at which the aggregation of latex, colorant, such as pigment and optional additives, is conducted. In general, the lower the aggregation temperature, the smaller the aggregate size, and thus the final toner size. For a latex polymer with a glass transition temperature (Tg) of about 55° C. and a reaction mixture with a solids content of about 14 percent by weight, an aggregate size of about 7 microns in volume average diameter is obtained at an aggregation temperature of about 53° C.; the same latex will provide an aggregate size of about 5 microns at a temperature of about 48° C. under similar conditions.

Cationic coagulants that can be selected include, for example, polyaluminum chloride or polyaluminum sulfosilicate, and which coagulants are effective as aggregating agents in a pH environment of about 2 to about 3.5. As the pH is increased, the effectiveness of the coagulant as an aggregating agent is reduced; for example, when the pH of the mixture is increased from about 4 to about 5.5, the effectiveness of aggregation can be reduced by about 50 percent.

Examples of the first coagulant include those as illustrated herein, such as calcium chloride, calcium nitrate and other water soluble calcium salts in the amount corresponding to a range of calcium ion concentration of from 100 to 400 parts per million calcium by weight of the toner.

Illustrative examples of specific latex resins, resin, polymer or polymers selected for the process disclosed herein and present in the latex include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly (styrene-butylacrylate), poly(styrene-butadiene), poly(styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner disclosed herein in various suitable amounts, such as from about 75 weight percent to about 90 weight percent, or from about 80 weight percent to about 87 weight percent of the toner or of the solids, and the latex size suitable for the processes disclosed herein can be, for example, from about 0.05 micron to about 0.5 micron in volume average diameter as measured by the Brookhaven nanosizer particle analyzer. Other sizes and effective amounts of latex polymer may be selected in embodiments.

The total of all toner components, such as resin and colorant, is about 100 percent, or about 100 parts.

The polymer selected for the processes disclosed herein can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference; mechanical grinding processes, or other known processes.

Examples of waxes include those as illustrated herein, such as those of the aforementioned copending applications, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions disclosed herein are believed to have a molecular weight of from about 4,000 to about 5,000. Examples of functionalized waxes include, such as amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes commercially available from Allied Chemical and Petrolite Corporation and SC Johnson wax.

Various known colorants, such as pigments, selected for the processes disclosed herein and present in the toner in an effective amount of, for example, from about 1 to about 25 percent by weight of toner, and more specifically, in an amount of from about 3 to about 10 percent by weight, that can be selected include, for example, carbon black like REGAL 330®. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180 and Permanent Yellow FGL components may also be selected as pigments with the process disclosed herein wherein the pigment is in the range of about 3 to about 15 weight percent of the toner. Dye examples include known suitable dyes, reference the Color Index, and a number of U.S. patents, such as food dyes, and the like.

Colorants include pigment, dye, mixtures of pigment and dyes, mixtures of pigments, mixtures of dyes, and the like.

Examples of initiators for the latex preparation include water soluble initiators, such as ammonium and potassium persulfates, in suitable amounts, such as from about 0.1 to about 8 percent and more specifically, in the range of from about 0.2 to about 5 percent (weight percent). Examples of organic soluble initiators include Vazo peroxides, such as VAZO 64™, 2-methyl 2-2'-azobis propanenitrile, VAZO 88™, 2-2'-azobis isobutyramide dehydrate in a suitable amount, such as in the range of from about 0.1 to about 8 percent. Examples of chain transfer agents include dodecanethiol, octanethiol, carbon tetrabromide and the like in various suitable amounts, such as from about 0.1 to about 10 percent and more specifically from about 0.2 to about 5 percent by weight of monomer.

Surfactants for the preparation of latexes, wax dispersions and colorant dispersions can be ionic or nonionic surfactants in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ obtained from Kao, and the like.

Examples of nonionic surfactants selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, can be selected.

The toner may also include known charge additives in effective suitable amounts of, for example, from 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972®. The coated silicas of U.S. Pat. No. 6,190,815 and U.S. Pat. No. 6,004,714, the disclosures of which are totally incorporated herein by reference, can also be selected in amounts, for example, of from about 0.1 to about 2 percent, which additives can be added during the aggregation or blended into the formed toner product.

Developer compositions can be prepared by mixing the toners obtained with the processes disclosed herein with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners disclosed herein, reference for example a number of the patents mentioned herein, and U.S. Pat. Nos. 4,265,990; 4,858,884; 4,584,253 and 4,563,408, the disclosures of which are totally incorporated herein by reference.

The following Examples and Comparative Examples are provided.

EXAMPLES

Latex Preparation/Semi-Continuous Method:

A latex emulsion comprised of polymer particles generated from the emulsion polymerization of styrene, butyl acrylate and beta carboxylethyl acrylate (β CEA) was prepared as follows.

An aqueous surfactant solution of 1.59 kilograms of DOWFAX 2A1™ (anionic emulsifier) and 430 kilograms of deionized water was prepared by mixing these components for 10 minutes in a stainless steel holding tank. The holding tank was then purged with nitrogen for 5 minutes before transferring into the reactor. The reactor was then continuously purged with nitrogen while being stirred at 100 RPM. The reactor was then heated to 80° C. Separately, 6.8 kilograms of ammonium persulfate initiator were dissolved in 33.55 kilograms of deionized water.

Separately, a monomer emulsion was prepared in the following manner. 366 Kilograms of styrene, 86 kilograms of butyl acrylate, 14 kilograms of β CEA, 6 kilograms of 1-dodecanethiol, 3 kilograms of dodecanediol diacrylate (ADOD), 8.05 kilograms of DOWFAX™ (anionic surfactant), and 216 kilograms of deionized water were mixed to form an emulsion; 5 percent of this emulsion was then slowly fed into the reactor containing the above aqueous surfactant phase at 80° C. to form "seeds" while being purged with nitrogen. The above prepared initiator solution was then slowly charged into the reactor and after 10 minutes the remainder 95 percent of the monomer emulsion was continuously fed in using metering pumps.

Once all the monomer emulsion was charged into reactor, the temperature was held at 80° C. for an additional 2 hours to complete the reaction. The reactor contents were then cooled to 35° C. The latex comprised of styrene, butyl acrylate and beta carboxylethyl acrylate (β CEA) (in the ratio of 76.5:23.5:3 ppH, respectively) resin particles were collected into a holding tank. After drying, the latex resin of styrene, butyl acrylate and beta carboxylethyl acrylate (β CEA) had molecular properties which were $M_w$=34,500, $M_n$=11,400 as measured by a GPC, and the onset Tg was 52.6° C. as measured by DSC. The latex was comprised of 40 percent resin, 58.5 percent water and 1.5 percent anionic surfactant.

TONER PREPARATION EXAMPLES

Comparative Example 1

Preparation of Black Toner Containing Wax:

175 Grams of the above prepared latex emulsion and 20 grams of aqueous R330® carbon black dispersion having a solids content of 25 percent were simultaneously added to 510 milliliters of water at room temperature, about 22 to about 25° C. throughout, while being mixed at a shear speed of 5,000 rpm by means of a polytron. To this mixture were added 24 grams of an aqueous anionic polyethylene P725 wax dispersion having a solids content of 33 percent (mixture A).

A coagulant of a polyaluminum chloride in a solution of 0.01N nitric acid was prepared by diluting 1.8 grams of a concentrated polyaluminum chloride solution (assayed as containing 10 percent alumina) into 20 grams of 0.01N nitric acid (Solution B).

To the above mixture (A) were added over a period of 2 minutes 21.8 grams of the coagulant solution containing the polyaluminum chloride Solution (B), followed by blending at a speed of 5,000 rpm for a period of 10 minutes. The resulting mixture, with a pH of 2.7, was then transferred to a 2 liter reaction vessel and heated at a temperature of 51° C. for 60 minutes resulting in aggregates of a size of 5.3 microns and a GSD of 1.20 as measured on a Coulter Counter. To the toner aggregates resulting were added 43.5 grams of the above prepared latex, followed by stirring for an additional 20 minutes while being heated at 54° C. The aggregates comprising latex, colorant and wax had a particle size of 5.5 and a GSD of 1.21.

The pH was adjusted from 2.7 to about 7 with an aqueous base solution of 4 percent sodium hydroxide, and the mixture resulting was allowed to stir for an additional 15 minutes. Subsequently, the resulting mixture was heated to 95° C. and retained there for a period of 1 hour. The pH of the resultant mixture was then lowered from about 6.6 to about 4.5 with 5 percent nitric acid. After 6 hours (total) at a temperature of 95° C., the particles had a diameter size of 5.7 microns with a GSD of 1.21. The reactor was then cooled down to room temperature (22 to 25° C.) and the particles were washed 5 times, where the first wash was conducted at a pH of 9 using sodium hydroxide to elevate the pH, at a temperature of 60° C., followed by 2 washes with deionized water at room temperature, and a further wash at a pH of 2 using nitric acid to lower the pH. The toner particles were then dried on a freeze dryer. The toner was comprised of 87 percent resin comprised of 76.5:23.5:3 ppH of styrene, butyl acrylate and beta carboxylethyl acrylate (β CEA), 5 percent of the above carbon black pigment and 8 percent P725 wax.

The tribo-charge of the above toner was measured using a Faraday cage blow off apparatus after conditioning at about 24 hours at 20 percent and 80 percent RH against a reference carrier (steel or ferrite with a polymer coating of PMMA and KYNAR®) in a Xerox Corporation DC265 copier/printer at a toner to carrier mass ratio of 6 percent. The charge to mass of the toner was −60 microcoulombs per gram at 20 percent RH and −20 microcoulombs per gram at 80 percent RH. Further 100 grams of the developer at 6 percent toner load (TC) was aged by being subjected to 60 minutes of mixing in a paint shaker. This test simulates the aging observed in an aggressive development housing. The toner tribo-charge of the aged toner at 20 percent RH was −55 microcoulombs per gram and −20 microcoulombs per gram at 80 percent RH.

Comparative Example 2

Preparation of Black Toner Containing Wax Calcium Washed:

A toner was prepared in the manner as that outlined in Comparative Example 1 except for the application of a different washing procedure and employing calcium chloride.

175 Grams of the above prepared latex emulsion and 20 grams of aqueous R330® carbon black dispersion having a solids content of 25 percent were simultaneously added to 510 milliliters of water at room temperature while being mixed at a shear speed of 5,000 rpm by means of a polytron. To this mixture were added 24 grams of an aqueous anionic polyethylene P725 wax dispersion having a solids content of 33 percent (mixture A).

A coagulant of a polyaluminum chloride in a solution of 0.01N nitric acid was prepared by diluting 1.8 grams of a concentrated polyaluminum chloride solution (assayed as containing 10 percent alumina) into 20 grams of 0.01N nitric acid (Solution B).

To the above mixture (A) were added over a period of 2 minutes 21.8 grams of the above coagulant solution containing polyaluminum chloride Solution (B), followed by blending at a speed of 5,000 rpm for a period of 10 minutes. The resulting mixture, which had a pH of 2.7, was then transferred to a 2 liter reaction vessel and heated at a temperature of 51° C. for 60 minutes resulting in aggregates of a size of 5.3 microns and a GSD of 1.20 as measured on a Coulter Counter. To the toner aggregates were added 43.5 grams of the above prepared latex, followed by stirring for an additional 20 minutes while being heated at 54° C. The aggregates comprising latex, colorant and wax had a particle size of 5.5 and a GSD of 1.21.

The pH was then adjusted from 2.7 to about 7 with an aqueous base solution of 4 percent sodium hydroxide and allowed to stir for an additional 15 minutes. Subsequently, the resulting mixture was heated to 95° C. and retained there for a period of 1 hour. The pH of the resultant mixture was then lowered from about 6.6 to about 4.5 with 5 percent nitric acid. After 6 hours (total) at a temperature of 95° C., the particles had a size of 5.7 microns with a GSD of 1.21. The reactor was then cooled down to room temperature (22° C. to 25° C.) and the particles resulting were washed 5 times, where the first wash was conducted at a pH of 9 and 60° C. using sodium hydroxide to raise the pH, followed by a wash with a dilute solution of calcium chloride (2 grams of calcium chloride per liter of water), one wash with deionized water at room temperature, and a further wash at a pH of 2 using nitric acid to lower the pH. The toner particles resulting were then dried on a freeze dryer. The toner resulting was comprised of 87 percent resin comprised of 76.5:23.5:3 ppH of styrene, butyl acrylate and beta carboxylethyl acrylate (β CEA), 5 percent of the above carbon black pigment and 8 percent of P725 wax.

The tribo-charge of this toner was measured using a Faraday Cage blow off apparatus after conditioning at about 24 hours at a 20 percent and 80 percent RH against the Xerox Corporation DC265 carrier at a toner to carrier mass ratio of 6 percent. The charge to mass of the toner was −35 microcoulombs per gram at 20 percent RH and −18 microcoulombs per gram at 80 percent RH. Further, 100 grams of the developer at 6 percent toner load were aged by being subjected to 60 minutes in a paint shaker. The 60 minute paint shake tribo-charge of the aged toner at 20 percent RH was −50 microcoulombs per gram and −20 microcoulombs per gram at 80 percent RH.

Example I

Preparation of Black Toner Containing Wax Calcium Co-Coagulant:

175 Grams of the above prepared latex emulsion and 20 grams of an aqueous R330® carbon black dispersion having a solids content of 25 percent were simultaneously added to 510 milliliters of water at room temperature while being mixed at a shear speed of 5,000 rpm by means of a polytron. To this mixture were added 24 grams of an aqueous anionic polyethylene P725 wax dispersion having a solids content of 33 percent mixture (A).

A combined coagulant solution comprising both polyaluminum chloride and calcium chloride in a solution of 0.01N nitric acid was prepared by diluting 1.8 grams of a concentrated polyaluminum chloride solution (assayed as containing 10 percent alumina) into 20 grams of 0.01N nitric acid and adding 0.5 gram of dry calcium chloride to this solution. (Solution B).

To the above mixture (A) were added over a period of 2 minutes 22.3 grams of the above prepared dual coagulant solution containing polyaluminum chloride and calcium chloride, solution (B), and blended at a speed of 5,000 rpm for a period of 10 minutes. The resulting mixture, which had a pH of 2.7, was then transferred to a 2 liter reaction vessel and heated at a temperature of 51° C. for 60 minutes resulting in toner aggregates of a size of 5.2 microns and a GSD of 1.21 as measured on a Coulter Counter. To the toner aggregates were added 43.5 grams of the above prepared latex, followed by stirring for an additional 20 minutes while being heated at 54° C. The aggregates comprising latex, colorant and wax had a particle size of 5.4 and a GSD of 1.20.

The pH was then adjusted from 2.7 to about 7 with an aqueous base solution of 4 percent sodium hydroxide, and the resulting mixture was allowed to stir for an additional 15 minutes. Subsequently, the resulting mixture was heated to 95° C. and retained there for a period of 1 hour. The pH of the resultant mixture was then lowered from about 6.6 to about 4.5 with 5 percent nitric acid. After 6 hours (total) at a temperature of 95° C., the particles had a size of 5.6 microns with a GSD of 1.21. The reactor was then cooled down to room temperature and the particles were washed 4 times with deionized water at room temperature. The resulting toner particles were then dried on a freeze dryer. The toner was comprised of 87 percent resin comprised of 76.5:23.5:3 ppH of styrene, butyl acrylate and beta carboxylethyl acrylate (β CEA) and 5 percent of the above carbon black pigment and 8 percent P725 wax.

The tribo-charge of this toner was measured using a Faraday Cage blow off apparatus after conditioning at 24 hours at 20 percent and 80 percent RH against a reference carrier of the Xerox DC265 copier/printer at a toner to carrier mass ratio of 6 percent. The charge to mass of the toner was −32 microcoulombs per gram at 20 percent RH and −21 microcoulombs per gram at 80 percent RH. Further, 100 grams of the developer at 6 percent toner load were aged by being subjected to 60 minutes in a paint shaker. The 60 minute paint shake tribo-charge of the aged toner at 20 percent RH was −35 microcoulombs per gram and −22 microcoulombs per gram at 80 percent RH.

Example II

Preparation of Red Toner Containing Wax Calcium Co-coagulant:

175 Grams of the above prepared latex emulsion and 20 grams of an aqueous Red R238 dispersion having a solids content of 25 percent were simultaneously added to 510 milliliters of water at room temperature while being mixed at a shear speed of 5,000 rpm by means of a polytron. To this mixture were added 24 grams of an aqueous anionic polyethylene P725 wax dispersion having a solids content of 33 percent mixture (A).

A combined coagulant solution comprising polyaluminum chloride and calcium chloride in a solution of 0.01N nitric acid was prepared by diluting 1.8 grams of a concentrated polyaluminum chloride solution (assayed as containing 10 percent alumina) into 20 grams of 0.01N nitric acid and adding 0.5 gram of dry calcium chloride to this solution (Solution B).

To the above mixture (A) were added over a period of 2 minutes 22.3 grams of the above prepared dual coagulant solution containing polyaluminum chloride and calcium chloride, solution (B), and followed by blending at a speed of 5,000 rpm for a period of 10 minutes. The resulting mixture, which had a pH of 2.7, was then transferred to a 2 liter reaction vessel and heated at a temperature of 51° C. for 60 minutes resulting in aggregates of a size of 5.2 microns and a GSD of 1.21 as measured on a Coulter Counter. To the toner aggregates were added 43.5 grams of the above prepared latex, followed by stirring for an additional 20 minutes while being heated at 54° C. The aggregates comprising latex, colorant and wax had a particle size of 5.4 and a GSD of 1.20.

The pH was then adjusted from 2.7 to about 7 with an aqueous base solution of 4 percent sodium hydroxide and allowed to stir for an additional 15 minutes. Subsequently, the resulting mixture was heated to 95° C. and retained there for a period of 1 hour. The pH of the resultant mixture was then lowered from about 6.6 to about 4.5 with 5 percent nitric acid. After 6 hours (total) at a temperature of 95° C., the particles had a size of 5.6 microns with a GSD of 1.21. The reactor was then cooled down to room temperature, and the particles obtained were washed 4 times with deionized water at room temperature. The resulting toner particles were then dried on a freeze dryer. The toner obtained was comprised of 87 percent resin comprised of 76.5:23.5:3 ppH of styrene, butyl acrylate and beta carboxylethyl acrylate (β CEA), 5 percent of the above carbon black pigment and 8 percent P725 wax.

The tribo-charge of this toner was measured using a Faraday Cage blow off apparatus after conditioning at about 24 hours at 20 and 80 percent RH against the Xerox Corporation DC265 carrier at a toner to carrier mass ratio of 6 percent. The charge to mass of the toner was −30 microcoulombs per gram at 20 percent RH and −18 microcoulombs per gram at 80 percent RH. Further, 100 grams of the developer at 6 percent toner load, TC, was aged for 60 minutes in a paint shaker. The 60 minute paint shaker tribo-charge of the aged toner at 20 percent RH was −33 microcoulombs per gram and −21 microcoulombs per gram at 80 percent RH.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A process comprising blending a latex emulsion of resin, water, and an ionic surfactant, a colorant dispersion comprised of a colorant, water, and an ionic surfactant, and a wax dispersion comprised of wax, water and an ionic surfactant; heating the resulting mixture in the presence of at least two dissimilar coagulants, one of which is a source of calcium ions, which heating is below about the glass transition temperature (Tg) of the latex resin, and subsequently heating above about the glass transition temperature (Tg) of the latex resin.

2. A process in accordance with claim 1 wherein said source of calcium ions is a calcium halide.

3. A process in accordance with claim 2 wherein said calcium halide is calcium chloride.

4. A process in accordance with claim 2 wherein said calcium halide is a calcium chloride, and said second coagulant is a polyaluminum chloride.

5. A process in accordance with claim 4 wherein said amount is from about 200 to about 250 parts per million.

6. A process in accordance with claim 1 wherein said second coagulant is aluminum sulfate, polyaluminum sulfosilicate, potassium aluminum sulfate or a polyferric sulfate.

7. A process in accordance with claim 1 wherein said coagulants are comprised of a mixture of coagulants, at least one of which is a calcium chloride, and which coagulant is present in an amount of from about 25 to about 500 parts per million, and wherein the pH of said blend is adjusted with an acid selected from the group consisting of nitric acid, sulfuric acid and hydrochloric acid.

8. A process in accordance with claim 1 wherein said second coagulant is selected in an amount of from about 0.075 to about 5 parts per hundred by weight of resulting toner comprised of resin, colorant, and wax, and wherein the total of said toner components is about 100 percent.

9. A process in accordance with claim 1 wherein said resin is a crosslinked polymer.

10. A process in accordance with claim 9 wherein said second latex forms a shell or coating on said toner aggregates, and wherein the thickness of the formed shell is from about 0.1 to about 1 micron.

11. A process in accordance with claim 10 wherein the second added latex contains the same resin as the initial latex, or wherein said added latex contains a dissimilar resin than that of the initial latex.

12. A process in accordance with claim 1 wherein there is added to the toner aggregates formed in the first heating a second latex comprised of submicron resin particles suspended in an aqueous phase containing an ionic surfactant, and wherein said second latex is selected in an amount of about 10 to about 40 percent by weight of the initial latex.

13. A process in accordance with claim 1 wherein heating at a temperature below about the glass transition temperature of said polymer or resin contained in the latex generates toner aggregates, and heating above the Tg permits coalescence of said polymer, said wax and said colorant.

14. A process in accordance with claim 13 wherein said aggregation temperature is from about 40° C. to about 60° C., and said coalescence temperature is from about 75° C. to about 97° C.

15. A process in accordance with claim 13 wherein the temperature at which the aggregation is accomplished controls the size of the aggregates, and wherein there is obtained a toner size of from about 2 to about 20 microns in volume average diameter.

16. A process in accordance with claim 13 wherein the pH of the mixture resulting subsequent to coagulation is increased from an initial of about 2 to about 2.6 to a final of about 5 to about 8 with base which functions primarily as a stabilizer for the aggregates during said coalescence.

17. A process in accordance with claim 13 wherein the colorant is a pigment, and wherein said pigment is in the form of a dispersion, which dispersion contains an ionic surfactant, and wherein said coagulants function to primarily enable aggregation of said latex resin, said wax, and said colorant.

18. A process in accordance with claim 1 wherein said latex resin is selected from the group comprised of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly (propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

19. A process in accordance with claim 1 wherein the colorant is carbon black, cyan, yellow, magenta, or mixtures thereof; there results a toner isolated of from about 2 to about 25 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner.

20. A process in accordance with claim 1 wherein there is accomplished a heating of the resulting mixture below the glass transition temperature (Tg) of the latex resin to form toner sized aggregates of resin, wax and colorant; adjusting the pH of said resulting toner aggregate mixture with a base from an initial pH of about 1.9 to about 3 to a pH of about 7 to about 9; heating the resulting aggregate suspension above the Tg of the latex resin to initiate the fusion or coalescence of the toner aggregates; changing the pH of the mixture by the addition of an acid to arrive at a pH of about 1.7 to about 3 to thereby accelerate said fusion or said coalescence, resulting in a toner comprised of resin, wax and colorant; and (x) optionally isolating said toner.

21. A process in accordance with claim 1 wherein said wax is comprised of polyethylene, polypropylene, or mixtures thereof.

22. A process in accordance with claim 1 wherein there is further included a second latex and which latex contains a crosslinked polymer, said colorant is carbon black, and said coagulants are comprised of a first coagulant of calcium chloride and a second coagulant of a polyaluminum chloride.

23. A process in accordance with claim 1 wherein said source of calcium ions functions to enable a stable triboelectric toner charge.

24. A process in accordance with claim 1 wherein said source of calcium ions enables a substantially constant toner triboelectric charge.

25. A process in accordance with claim 1 wherein said coagulants are comprised of from about 2 to about 6 coagulants.

26. A process in accordance with claim 1 wherein said heating is below the glass transition temperature of the latex resin, and said subsequent heating is above the glass transition temperature of the latex resin, and wherein said source of calcium ions is a calcium halide.

27. A toner process comprising (i) generating a colorant dispersion comprised of a colorant, water, and an ionic surfactant, and generating a latex emulsion comprised of resin, water, and an ionic surfactant; and wherein (ii) the colorant dispersion is blended with the latex emulsion;

(iii) adding at least two dissimilar coagulants to the resulting blend containing the latex and colorant, wherein one of said coagulants is a calcium halide;

(iv) heating the resulting mixture below about the glass transition temperature (Tg) of the latex resin;

(v) optionally adding a second latex comprised of resin particles suspended in an aqueous phase resulting in a shell;

(vi) followed by adjusting the pH of the mixture resulting with a base, and wherein the pH of the resulting toner aggregate mixture, which is at an initial pH of about 1.9 to about 3, is adjusted to a pH of about 7 to about 9;

(vii) heating the resulting aggregate suspension of (vi) above the Tg of the latex resin; and (viii) changing the pH of the above (vii) mixture by the addition of an acid to arrive at a pH of about 2.8 to about 5, followed by isolating said toner comprised of resin and colorant.

28. A process in accordance with claim 27 wherein there is added a wax dispersion to said blend of resin emulsion and colorant dispersion, and wherein said coagulant salt is calcium chloride.

29. A toner process comprising (i) blending a latex emulsion of resin, water, and an ionic surfactant with a colorant dispersion comprised of a colorant, water, and an ionic surfactant;

(ii) heating, in the presence of a coagulant and a calcium halide, the resulting mixture below the glass transition temperature (Tg) of the latex resin to obtain aggregates;

(iii) optionally adding a second latex comprised of sub-micron resin particles suspended in an aqueous phase;

(iv) adjusting the pH with a base of from an initial pH value of about 1.9 to about 3 to a pH of about 7 to about 9;

(v) heating above the latex polymer Tg temperature;

(vi) optionally retaining the temperature at from about 70° C. to about 95° C.;

(vii) changing the pH of the mixture with an acid to arrive at a pH of about 1.5 to about 3.5; and (viii) isolating the toner.

* * * * *